US006138800A

United States Patent [19]

Deramaux et al.

[11] Patent Number: 6,138,800

[45] Date of Patent: Oct. 31, 2000

[54] RAIL VEHICLE BRAKE DEVICE

[75] Inventors: Jean-Michel Deramaux, Saint-Saulve; Bernard Caron, Aulnoye-les-Valenciennes, both of France

[73] Assignee: Societe des Forges de Fresnes, Fresnes-sur-Escaut, France

[21] Appl. No.: 08/849,532

[22] PCT Filed: Dec. 15, 1995

[86] PCT No.: PCT/FR95/01674

§ 371 Date: Sep. 24, 1997

§ 102(e) Date: Sep. 24, 1997

[87] PCT Pub. No.: WO96/19372

PCT Pub. Date: Jun. 27, 1996

[30] Foreign Application Priority Data

Dec. 22, 1994 [FR] France ..... 94 15476

[51] Int. Cl.[7] ..... B61H 13/00

[52] U.S. Cl. ..... 188/33; 188/70 R; 188/219.1; 188/225.6

[58] Field of Search ..... 188/54, 219.1, 188/219.6, 220.1, 225.6, 35, 52, 70 R, 33, 59, 153 R, 153 A, 72.9, 58, 28, 56, 36

[56] References Cited

U.S. PATENT DOCUMENTS

| | | | |
|---|---|---|---|
| 595,496 | 12/1897 | Pickles | 188/33 |
| 2,359,788 | 10/1944 | Pierce | 188/33 |
| 2,359,806 | 10/1944 | Tack | 188/59 |
| 2,581,746 | 1/1952 | Baselt | 188/59 |
| 3,791,491 | 2/1974 | Tickle | 188/70 R |
| 4,008,789 | 2/1977 | Clemmons | 188/70 R |
| 4,193,479 | 3/1980 | Quilici | 188/72.9 |

FOREIGN PATENT DOCUMENTS 2194601 3/1974 France .

*Primary Examiner*—Michael Mar
*Assistant Examiner*—Thomas Williams
*Attorney, Agent, or Firm*—Greenblum & Bernstein, P.L.C.

[57] ABSTRACT

A braking device for a railroad vehicle including traction bars is arranged to apply a braking pad on a braking surface affixed to a wheel of the vehicle. The braking device includes a reaction member, at least one lever arranged to cooperate with the reaction member, connecting devices between the traction bars means and the lever, the braking pad being borne by the lever to be applied on the braking surface by pivoting the lever under the action of the traction bars and of the reaction member.

4 Claims, 4 Drawing Sheets

RAIL VEHICLE BRAKE DEVICE

BACKGROUND OF THE INVENTION

1. Field of the Invention

The present invention relates to a braking device for a railroad vehicle, and such a device, more particularly, includes traction means arranged to apply a braking pad on a braking surface affixed to a wheel of the vehicle.

2. Description of Background and Relevant Information

Devices of the aforementioned type are already known which are more particularly used on railroad freight cars. The braking pad acts by friction on the tire of the wheel to cause the braking. The traction means are generally constituted by a triangular member made of metallic bars and referred to as a brake triangle. This is an isosceles triangle, with its apex in the plane of symmetry of the car and its other two angles in the vicinity of two wheels of the car mounted on the same axle.

The braking force is applied at the apex of the triangle in the aforementioned plane of symmetry, and this force is also distributed between the two pads to apply them to the corresponding tire to cause the braking of the car.

Disk brakes, of the same type as those used in automobiles, are also known and are generally used on the motor coaches or passenger coaches. These brakes have the advantage of providing a very energetic braking, of being quieter and of generating less vibrations than the conventional brakes acting on the tires. However, they are very expensive and function in a total different manner. Therefore, they cannot be adapted to railroad vehicles provided with brake triangles.

Finally, a device is known from the document U.S. Pat. No. 4,008,789. However, this device comprises a complex hinged assembly.

SUMMARY OF THE INVENTION

The present invention aims at providing improved braking means for railroad vehicles. More particularly, it aims at providing a braking device combining the simplicity and robustness of the conventional brakes with a more efficient braking. It also has the object of providing such a device that can utilize the conventional braking chain having a brake triangle. In addition, it aims at increasing the braking capacity of such braking chains without increasing the braking force applied to the brake triangle.

To this end, the object of the invention is a braking device for a railroad vehicle including traction means arranged to apply a braking pad on a braking surface affixed to a wheel of the vehicle, a reaction member, at least one lever arranged to cooperate with said reaction member, connecting means between said traction means and said lever, characterized in that said braking pad is borne by said lever to be applied on said braking surface by pivoting of said lever under the action of said traction means and of said reaction member.

The lever device according to the invention makes it possible to increase the braking force while maintaining the same braking control chain as in the conventional devices.

In a particular embodiment of the invention, said reaction member is constituted by the tire of a wheel of the vehicle, said lever cooperating with said tire by means of a support element.

More particularly, said support element can form a braking pad, said braking surface then forming a complementary braking surface.

The complementary braking surface makes it possible to increase the braking capacity with respect to a conventional triangle braking device. Nevertheless, as has been previously indicated, the braking control chain is the same as in these conventional devices.

In an alternative embodiment, the support element does not participate in the braking and is constituted, for example, by a roller rolling on the tire.

In another embodiment of the invention, the reaction member is affixed to the structure of the vehicle. Of course, in the case where the vehicle is a bogie coach, the reaction member is in fact affixed to the bogie structure.

This embodiment makes it possible to avoid involving the tire of the wheel in the braking process, and therefore to avoid damaging it. As a result, noise and vibrations are reduced.

Still in a particular embodiment of the invention, said lever includes two lever arms on both sides of its fulcrum pin, one of the lever arms carrying the support element and the other carrying the braking pad.

More particularly, said braking surface can be a cylindrical surface coaxial with the wheel.

Said braking surface can also be a planar annular surface substantially parallel to the plane of the wheel and coaxial with the wheel.

In this last case, in particular, the device according to the invention can include two affixed braking surfaces, each associated with a pad and with a lever, the two pads exerting their forces in opposite directions on their respective braking surface.

It is thus possible to globally increase the braking force, and therefore the braking capacity of the device, without increasing the force exerted on the traction means. Indeed, the force exerted on the braking surfaces will generally be exerted laterally and compensated for.

According to the particular embodiment described hereinabove, the device according to the invention can include two pad-holding levers and an operating lever, one of said pad-holding levers being mounted at its end opposite the pad, pivoting on the reaction member, said operating lever also being pivotally mounted on the reaction member and being connected to the traction means, the end of the other pad-holding lever, opposing the pad, being connected to the operating lever, and said pad-holding levers being connected in their central zone by a connecting link.

BRIEF DESCRIPTION OF THE DRAWINGS

Several embodiments of this invention will now be described, by way of a non-limiting example, with reference to the annexed schematic drawings in which.

DETAILED DESCRIPTION OF THE PREFERRED EMBODIMENTS

Figure 1:
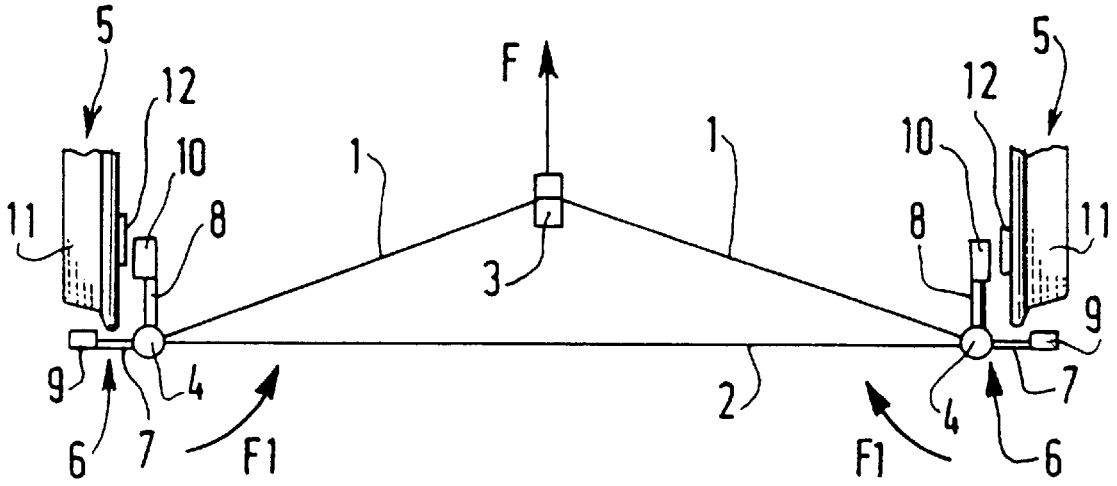
FIG. 1 illustrates a top view of a first embodiment of the invention.

FIG. 1 shows a brake triangle of a known type, formed of two metallic bars 1 of same length and of a third bar 2. A jack, not shown, makes it possible to exert a force illustrated by the arrow F at the point 3 common to the two bars 1.

The points 4 common, on the one hand, to the bar 2, and on the other hand, to each of the bars 1, respectively, are located in the vicinity of each of the wheels 5 carried by a common wheel shaft of the vehicle. When the traction force F is exerted at the point 3, the points 4 come closer to the axle of the wheels 5.

The points 4 are in fact hinge pins for the levers 6 each comprising two lever arms 7 and 8, respectively, at right angle. The lever arms 7 are substantially parallel to the axles of the wheels 5, whereas the arms 8 are substantially perpendicular to the axle of the wheels.

The lever arms 7, at their end opposite the hinge 4, carry a braking pad 9 by means of a pad holder (not shown). Likewise, the arms 8 carry a pad 10, at their end opposite the hinge 4. The holders are made of cast iron in a known manner, and the pads 10 are made of a composite friction material.

When a traction force F is exerted on the brake triangle, the pads 9, in a known manner, come into contact with the tires 11 of the wheels 5, which results in providing a first braking force. By reaction, the levers 6 pivot in the direction of the arrows F1. In this movement, each pad 10 comes into contact with an annular friction band 12 located in a plane parallel to the plane of the wheel, which results in providing a second braking force.

The annular bands 12 are made of any suitable friction material. They are coaxial with the wheels 5 to which they are attached, and to which they are therefore affixed in rotation.

Therefore, it is noted that, for the common traction force F as in the devices of the prior art, the invention makes it possible to apply a first braking force F/2 on the tires 11 of the wheels and, in addition, a second braking force on the bands 12. The two braking forces exerted on the two bands 12 are directed outwardly, and therefore opposed, which ensures the equilibrium of the brake triangle.

Figure 2:
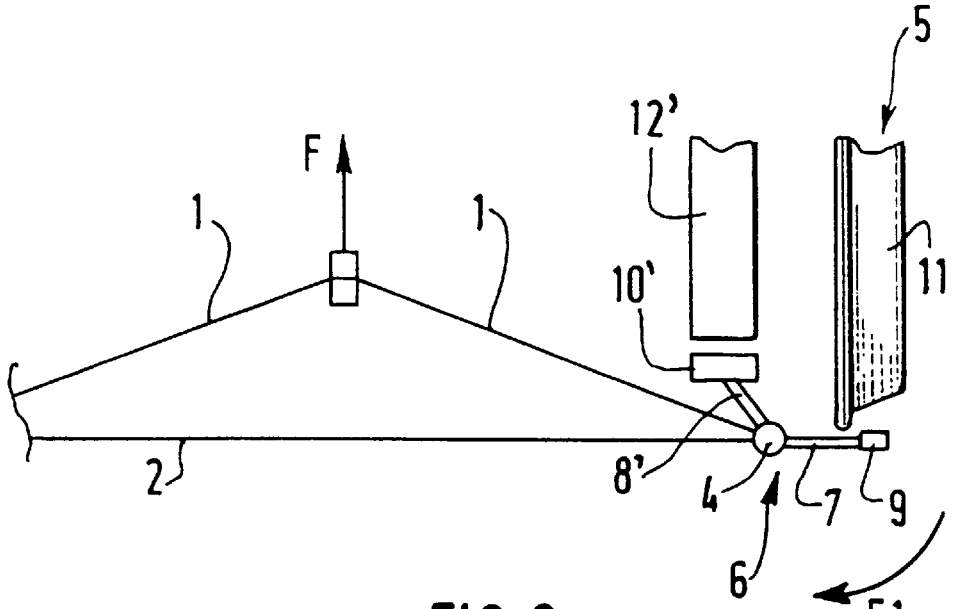
FIG. 2 illustrates a top view of a second embodiment of the invention.
Figure 3:
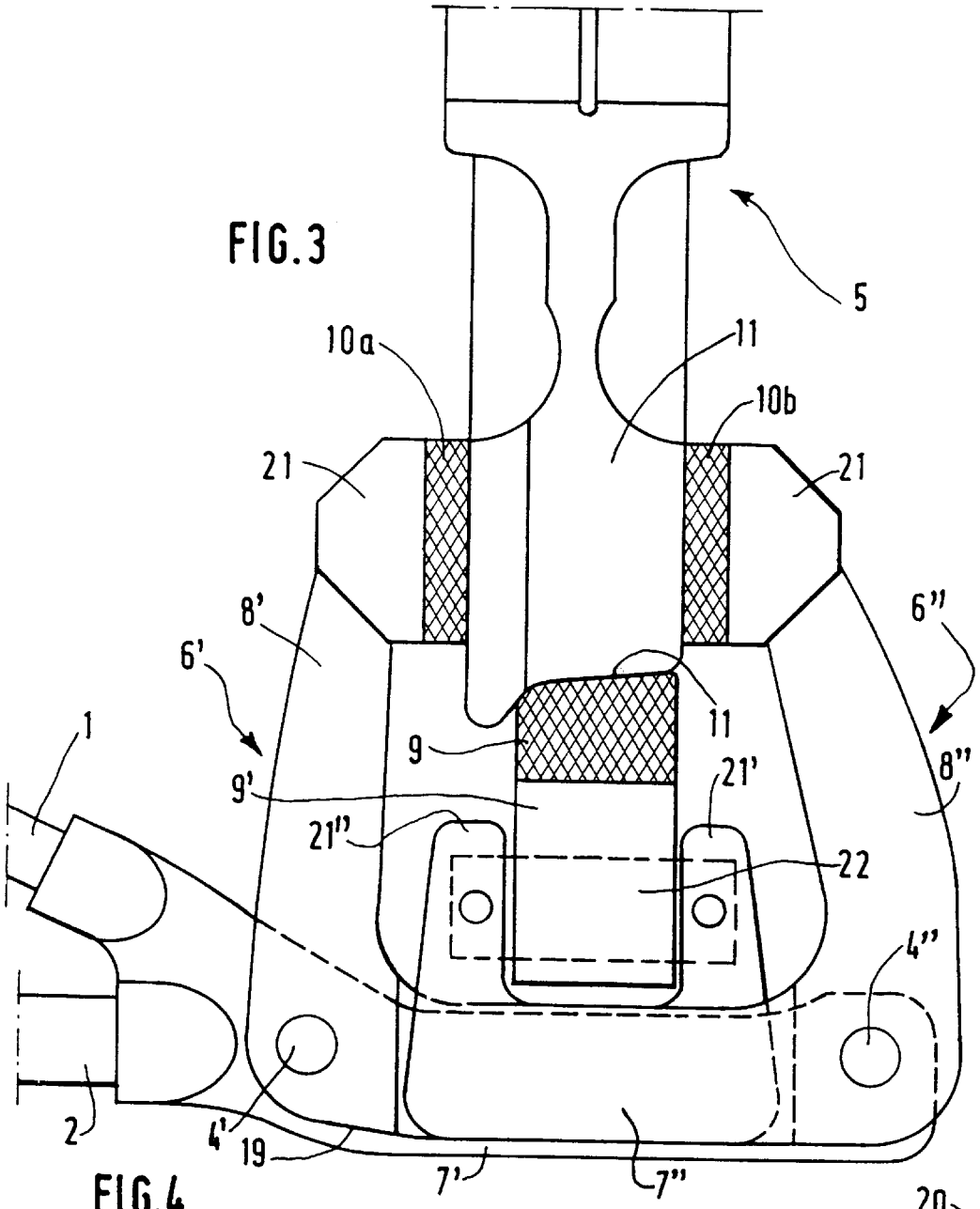
FIG. 3 is a partial top view of a third embodiment of the invention.
Figure 4:
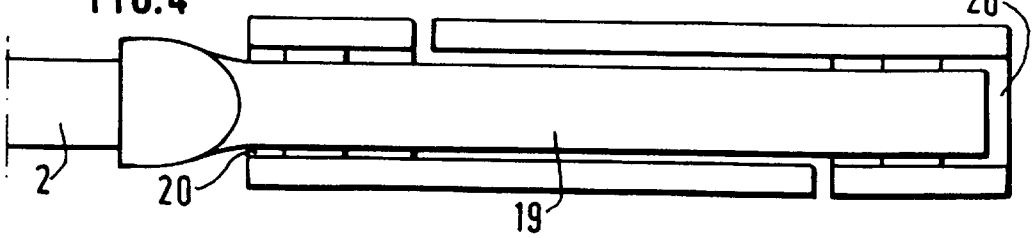
FIG. 4 is a front view.
Figure 5:
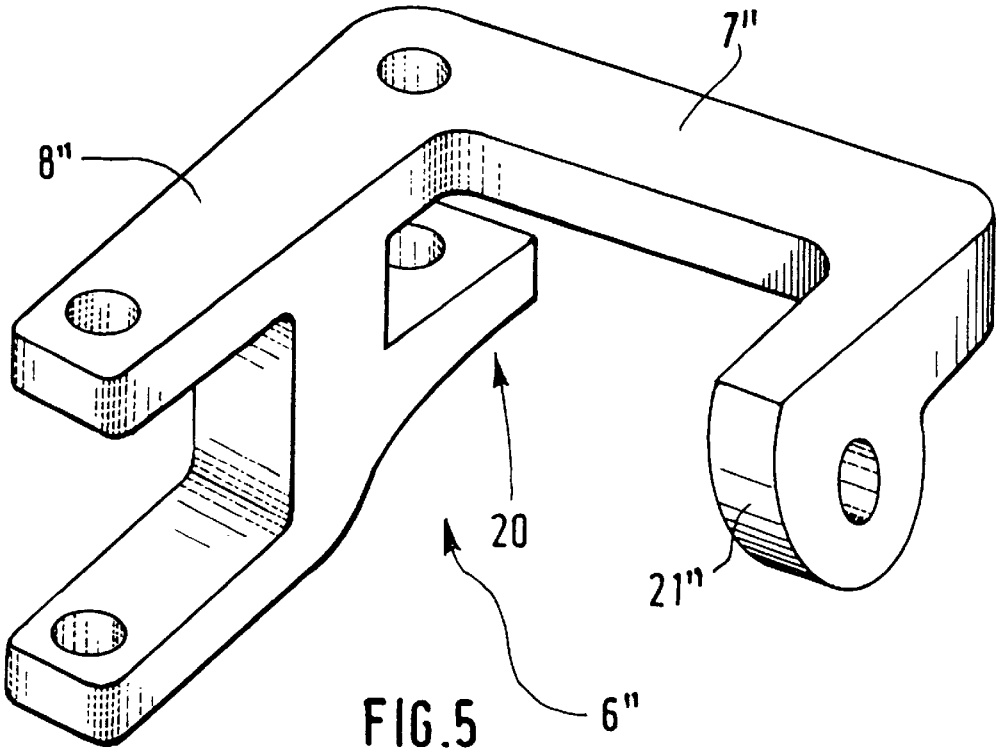
FIGS. 5 and 6 are perspective views of one of the levers of FIGS. 3 and 4.
Figure 6:
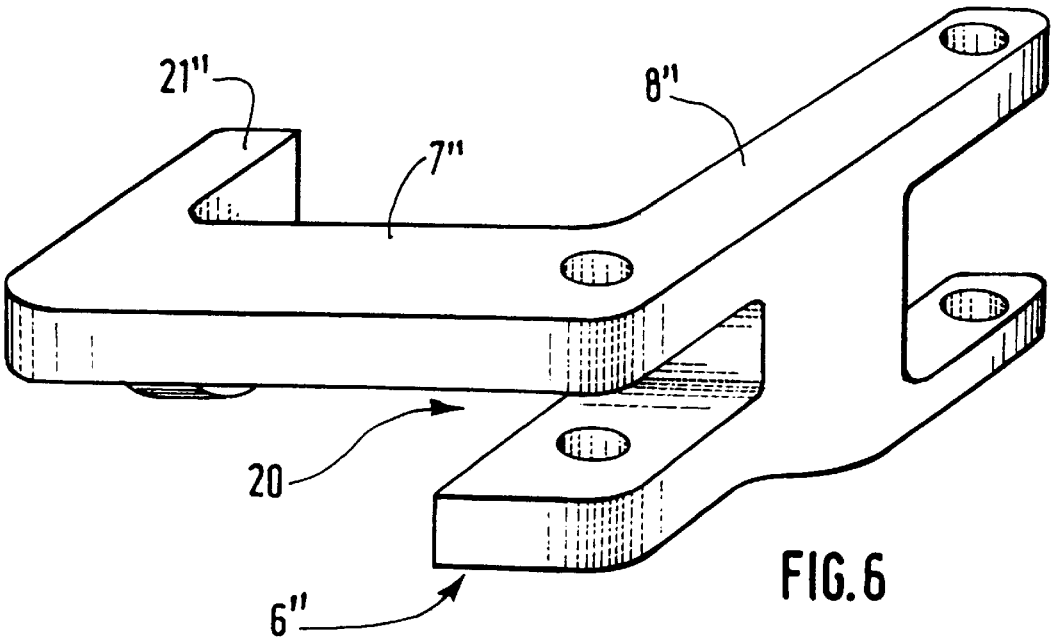

In the embodiment of FIG. 2, the lever arm opposite the lever arm 7, i.e., the lever arm 8', carries a pad 10' that cooperates with a cylindrical complementary braking surface 12', coaxial with the wheel 5. As previously, the tire 11 exerts on the pad 9 a reaction force which tends to cause the lever 6 to pivot about the hinge 4 in the direction of the arrow F1. The pad 10' is therefore applied against the surface 12', which, also in this case, provides a second braking force.

The embodiment of FIGS. 3–6 differs from that of FIG. 1, essentially in that it includes two levers 6' and 6" mounted on hinges 4' and 4". These hinges are here carried on an element 19 mounted at the end of the bars 1 and 2 and are constituted by caps mounted on axles 4' and 4". The pad-holders 21 are mounted on the lever arms 8' and 8" and support the friction pads 10*a* and 10*b*.

The lever arms 7' and 7" here carry, at their end, return projections 21' and 21" which jointly receive a horizontal axle 22 parallel to the axle of the wheels, and support the pad-holder 9'. The axle 22 therefore connects the ends of the lever arms 7' and 7" and the pad holder 9'.

The wheel 5 here carries two complementary friction surfaces on which two pads 10*a* and 40*b* act. It is thus used as the disk in the known disc brakes.

When a traction is exerted on the brake triangle, the pad 9 is pressed on the tire 11 which pushes back the axle 22 and causes the levers 6' and 6" to pivot about the axles 4' and 4", such that the pads 10*a* and 10*b* are applied on the complementary braking bands.

Figure 7:
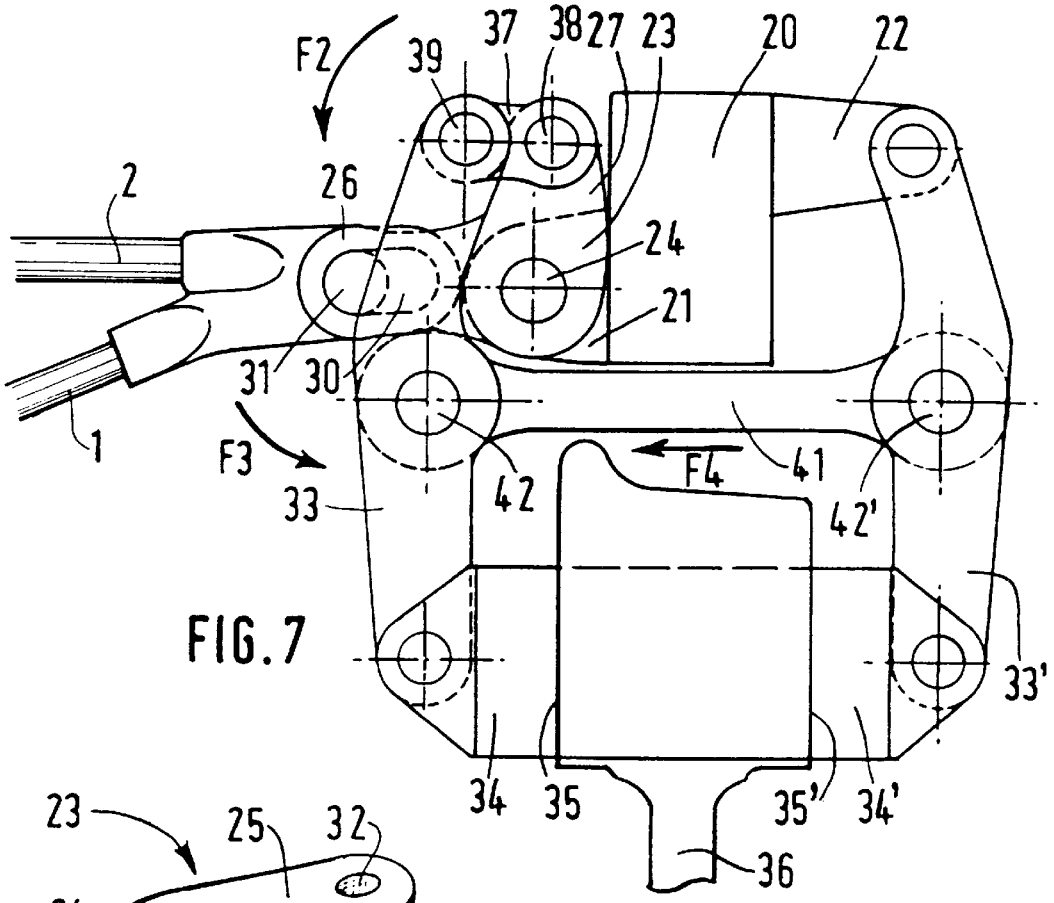
FIG. 7 is a top view of a fourth embodiment of the invention.
Figure 8:
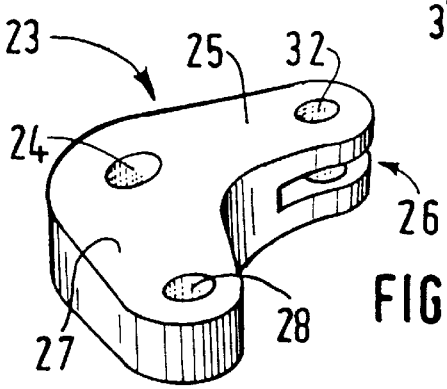
FIGS. 8 and 9 are perspective views of two of the members of of the device of FIG. 7.
Figure 9:
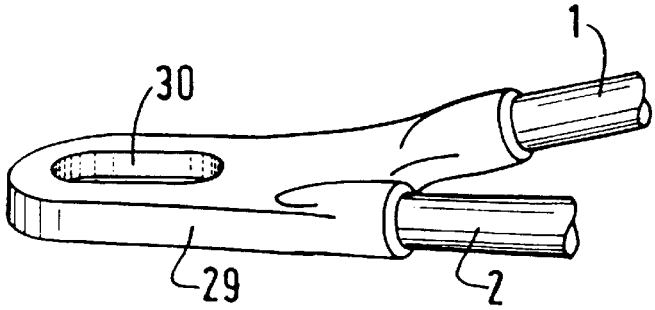

In the embodiment of FIGS. 7–9, the reaction member is a fixed member 20 affixed to the structure carrying the wheels, and therefore to either the wagon body or to the bogie structure. This member 20 supports two fixing lugs 21 and 22 whose function will be discussed hereinafter.

A square-shaped operating lever 23 is mounted on the lug 21 to pivot in its center point about an axis 24. The end of one of its arms 25 forms a fork 26 and the end of its other arm 27 has a bore 28.

The ends of the bars 1 and 2 support a connector 29 in which an oblong opening 30 is formed. An axle 31 extends through the holes 32 of the fork 26 and the hole 30.

One of the ends of two levers 33 and 33' supports a braking pad 34 and 34' cooperating respectively with braking surfaces 35 and 35' formed on the flanks of the wheel 36. In a variation, the surfaces 35 and 35' could be formed on a disk mounted fixedly on the axle of the wheel 36.

A connecting rod 37 connects the end of the arm 27 of the square 23 to the end of the lever 33 opposite the pad 34. To this end, this connecting rod is hinged at one of its ends on an axle 38 extending through the hole 28, and at its other end on an axle 39 mounted on the aforementioned end of the lever 33 opposite the pad 34.

The end of the lever 33' opposite the pad 34' is hinged on the lug 22 of the fixed member 20. The median zones of the levers 33 and 33' are connected by connecting links 41 fixed to axles 42 and 42', respectively.

When a traction is exerted on the brake triangle, it leads the square 23 to pivot in the direction of the arrow F2. The latter in turn leads the lever 33 to pivot in the direction of the arrow F3 about the axle 42. As a result, there is a support of the pad 34 on the braking surface 35, on the one hand, and a traction is exerted by the link 41 on the lever 33' in the direction of the arrow F4, on the other hand. Thus, the two pads 34 and 34' are applied on their respective braking surface 35 and 35'. Therefore, the tire 43 of the wheel 36, in this embodiment, is not biased.

What is claimed is:

1. A braking device for a railroad vehicle, comprising:

a traction member arranged to apply a pair of braking pads on respective opposite sides of a planar annular braking surface affixed to a wheel of the vehicle. the planar annular braking surface being substantially parallel to the plane of the wheel and coaxial to the wheel;

a reaction member;

a pair of levers each adapted to pivot upon contacting said reaction member. a respective said braking pad being affixed to a respective one of said pair of levers, said pads adapted to exert respective forces in opposite directions on a respective side of said braking surface; and a connector between said traction member and at least one lever of said pair of levers;

wherein said traction member is adapted to move said pair of levers to a position in which said reaction member pushes said pair of levers and said pair of levers pivot, thereby applying said braking pad on said braking surface;

said reaction member comprising a tire of a wheel of the vehicle, said pair of levers being adapted to pivot upon contacting said tire by a support element.

2. The braking device according to claim 1, wherein said support element comprises a braking sole, said braking surface comprising a complementary braking surface.

3. The braking device according to claim 1, each of said pair of levers comprising two lever arms on a respective side of a fulcrum pin, one of said lever arms holding said support element, and the other said lever arm holding said braking element.

4. A braking device for a railroad vehicle including traction means arranged to apply a braking pad on a braking surface affixed to a wheel of the vehicle, a reaction member affixed to a structure of the vehicle, at least one lever adapted to pivot upon contacting said reaction member, and connecting means between said traction means and said lever, wherein said traction means is adapted to move said lever to a position in which said reaction member pushes said lever and said lever pivots, applying said braking pad on said braking surface, further comprising two pad-holding levers and an operating lever, one of said pad-holding levers being pivotally mounted on the reaction member at its end opposite the pad, said operating lever also being pivotally mounted on the reaction member and connected to the traction means, the end of the other pad-holding lever being opposite the pad that is connected to the operating lever, said pad-holding levers being connected to each other at a respective central zone of the pad-holding levers by a connecting link.

* * * * *